United States Patent [19]

Sanderson

[11] 3,968,719

[45] July 13, 1976

[54] METHOD FOR TUNING MUSICAL INSTRUMENTS

[75] Inventor: Albert E. Sanderson, Carlisle, Mass.

[73] Assignee: Inventronics, Inc., Carlisle, Mass.

[22] Filed: Oct. 3, 1974

[21] Appl. No.: 511,921

Related U.S. Application Data

[60] Continuation-in-part of Ser. No. 399,990, Sept. 24, 1973, abandoned, which is a division of Ser. No. 249,942, May 3, 1972, abandoned.

[52] U.S. Cl. ..... 84/454; 324/79 R

[51] Int. Cl.[2] ..... G10G 7/02

[58] Field of Search ..... 84/1.01, 454, 444; 324/79 R, 79 D, 81

[56] References Cited

UNITED STATES PATENTS

| | | | |
|---|---|---|---|
| 2,958,250 | 11/1960 | Poehler | 84/454 |
| 3,509,454 | 4/1970 | Gossel | 84/454 X |
| 3,631,756 | 1/1972 | Mackworth-Young | 84/454 |
| 3,696,293 | 10/1972 | Hoffman et al. | 324/79 D |
| 3,722,353 | 6/1971 | Westhaver | 84/454 |
| 3,766,818 | 10/1973 | Prohofsky | 84/454 |

OTHER PUBLICATIONS

O. L. Railsback, "A Chromatic Stroboscope," J.A.S.A., pp. 37–42, vol. 9.

R. W. Young, "Inharmonicity of Pain Wire Piano Strings," J.A.S.A., pp. 267–273, vol. 24.

D. W. Martin et al., "Subjective Evaluation of Musical Scale Temperament in Pianos," J.A.S.A., pp. 582–585.

A. C. Van Der Woerd, "New Electronic Tuning Device for Pianos," pp. 2010–2017, J.A.S.A., vol. 51.

*Primary Examiner*—Ulysses Weldon

*Attorney, Agent, or Firm*—Cesari and McKenna

[57] ABSTRACT

A method for tuning a piano or other instrument. A characteristic stretch is measured using a tuning instrument which compares an internally generated reference signal and the corresponding partial of a note from the instrument and indicates the instantaneous phase difference between the two. A reference note in the instrument (e.g., the 440 Hz "A") is tuned to a standard frequency for the scale. Then, using the characteristic stretch, the deviation from a reference scale frequency for each successive note is determined and each note is tuned to a frequency which is the sum of the reference scale frequency and corresponding deviation for that note. In one particular embodiment, the stretch correction, Y($n$,N), in cents is based upon the following:

$$Y(n,N)=B_0[(n^2+K_2)2^{(N-N_0)/K_1}-1-K_2]$$

wherein $n$ equals the number of the partial of the note for which the deviation is being calculated, N is a number assigned to each note in a scale, $B_0$ is an inharmonicity factor for a reference note $N_0$ (e.g., 440 Hz"A"), $K_1$ is a slope factor and $K_2$ is an octave matching factor.

10 Claims, 9 Drawing Figures

| | | | | | | |
|---|---|---|---|---|---|---|
| 2 | | -3.2 | -3.0 | -2.7 | -2.5 | -2.2 |
| 2.5 | | -3.4 | -3.2 | -2.9 | -2.6 | -2.4 |
| 3 | | -3.7 | -3.4 | -3.1 | -2.8 | -2.5 |
| 3.5 | | -3.9 | -3.6 | -3.3 | -3.0 | -2.6 |
| 4 | | -4.1 | -3.8 | -3.4 | -3.1 | -2.8 |
| 4.5 | | -4.3 | -4.0 | -3.6 | -3.3 | -2.9 |
| 5 | | -4.5 | -4.2 | -3.8 | -3.4 | -3.1 |
| 5.5 | | -4.7 | -4.4 | -4.0 | -3.6 | -3.2 |
| 6 | | -4.9 | -4.6 | -4.2 | -3.8 | -3.3 |
| 6.5 | | -5.2 | -4.8 | -4.3 | -3.9 | -3.5 |
| 7 | | -5.4 | -5.0 | -4.5 | -4.1 | -3.6 |
| 7.5 | | -5.6 | -5.2 | -4.7 | -4.2 | -3.8 |
| 8 | | -5.8 | -5.3 | -4.9 | -4.4 | -3.9 |
| 8.5 | | -6.0 | -5.5 | -5.1 | -4.6 | -4.0 |
| 9 | | -6.2 | -5.7 | -5.2 | -4.7 | -4.2 |
| -2.0 | -1.7 | -1.5 | -1.3 | -1.0 | -.7 | -.5 |
| -2.1 | -1.8 | -1.6 | -1.3 | -1.0 | -.7 | -.4 |
| -2.2 | -1.9 | -1.6 | -1.3 | -1.0 | -.7 | -.3 |
| -2.3 | -2.0 | -1.7 | -1.4 | -1.0 | -.6 | -.3 |
| -2.4 | -2.1 | -1.7 | -1.4 | -1.0 | -.6 | -.2 |
| -2.6 | -2.2 | -1.8 | -1.4 | -1.0 | -.6 | -.1 |
| -2.7 | -2.3 | -1.9 | -1.4 | -1.0 | -.4 | 0 |
| -2.8 | -2.4 | -1.9 | -1.5 | -1.0 | -.5 | 0 |
| -2.9 | -2.5 | -2.0 | -1.5 | -1.0 | -.5 | .1 |
| -3.0 | -2.6 | -2.1 | -1.5 | -1.0 | -.4 | .2 |
| -3.1 | -2.6 | -2.1 | -1.6 | -1.0 | -.4 | .2 |
| -3.3 | -2.7 | -2.2 | -1.6 | -1.0 | -.4 | .3 |
| -3.4 | -2.8 | -2.3 | -1.6 | -1.0 | -.3 | .4 |
| -3.5 | -2.9 | -2.3 | -1.7 | -1.0 | -.3 | .5 |
| -3.6 | -3.0 | -2.4 | -1.7 | -1.0 | -.3 | .5 |
| -.2 | .1 | .3 | .6 | 1.0 | 1.3 | |
| -.1 | .2 | .6 | .9 | 1.3 | 1.7 | |
| 0 | .4 | .8 | 1.2 | 1.6 | 2.0 | |
| .1 | .5 | 1.0 | 1.4 | 1.9 | 2.4 | |
| .2 | .7 | 1.2 | 1.7 | 2.2 | 2.8 | |
| .4 | .9 | 1.4 | 2.0 | 2.6 | 3.2 | |
| .5 | 1.0 | 1.6 | 2.2 | 2.9 | 3.6 | |
| .6 | 1.2 | 1.8 | 2.5 | 3.2 | 4.0 | |
| .7 | 1.3 | 2.0 | 2.7 | 3.5 | 4.4 | |
| .8 | 1.5 | 2.2 | 3.0 | 3.8 | 4.7 | |
| .9 | 1.7 | 2.4 | 3.3 | 4.2 | 5.1 | |
| 1.0 | 1.8 | 2.7 | 3.5 | 4.5 | 5.5 | |
| 1.2 | 2.0 | 2.9 | 3.8 | 4.8 | 5.9 | |
| 1.3 | 2.1 | 3.1 | 4.1 | 5.1 | 6.3 | |
| 1.4 | 2.3 | 3.3 | 4.3 | 5.5 | 6.7 | |

| | | | | | | | |
|---|---|---|---|---|---|---|---|
| -.5 | -.4 | -.2 | 0 | .2 | .4 | .7 | .9 |
| -.6 | -.4 | -.2 | 0 | .2 | .5 | .8 | 1.1 |
| -.7 | -.5 | -.3 | 0 | .3 | .6 | .9 | 1.2 |
| -.8 | -.6 | -.3 | 0 | .3 | .6 | 1.0 | 1.3 |
| -.9 | -.6 | -.3 | 0 | .3 | .7 | 1.1 | 1.5 |
| -1.0 | -.7 | -.4 | 0 | .4 | .8 | 1.2 | 1.6 |
| -1.1 | -.7 | -.4 | 0 | .4 | .8 | 1.3 | 1.7 |
| -1.2 | -.8 | -.4 | 0 | .4 | .9 | 1.4 | 1.9 |
| -1.3 | -.9 | -.4 | 0 | .5 | 1.0 | 1.5 | 2.0 |
| -1.4 | -.9 | -.5 | 0 | .5 | 1.0 | 1.6 | 2.1 |
| -1.4 | -1.0 | -.5 | 0 | .5 | 1.1 | 1.7 | 2.3 |
| -1.5 | -1.1 | -.5 | 0 | .6 | 1.2 | 1.8 | 2.4 |
| -1.6 | -1.1 | -.6 | 0 | .6 | 1.2 | 1.9 | 2.5 |
| -1.7 | -1.2 | -.6 | 0 | .6 | 1.3 | 2.0 | 2.7 |
| -1.8 | -1.2 | -.6 | 0 | .7 | 1.4 | 2.1 | 2.8 |
| 1.2 | 1.5 | 1.7 | 2.0 | .8 | .9 | 1.0 | 1.1 |
| 1.4 | 1.7 | 2.0 | 2.3 | .7 | .9 | 1.0 | 1.1 |
| 1.5 | 1.9 | 2.2 | 2.5 | .7 | .8 | 1.0 | 1.1 |
| 1.7 | 2.1 | 2.4 | 2.8 | .6 | .8 | 1.0 | 1.2 |
| 1.9 | 2.3 | 2.7 | 3.1 | .6 | .8 | 1.0 | 1.2 |
| 2.0 | 2.5 | 2.9 | 3.4 | .5 | .8 | 1.0 | 1.2 |
| 2.2 | 2.7 | 3.2 | 3.7 | .5 | .7 | 1.0 | 1.2 |
| 2.4 | 2.9 | 3.4 | 4.0 | .5 | .7 | 1.0 | 1.3 |
| 2.5 | 3.1 | 3.7 | 4.2 | .4 | .7 | 1.0 | 1.3 |
| 2.7 | 3.3 | 3.9 | 4.5 | .4 | .7 | 1.0 | 1.3 |
| 2.9 | 3.5 | 4.1 | 4.8 | .3 | .7 | 1.0 | 1.3 |
| 3.0 | 3.7 | 4.4 | 5.1 | .3 | .6 | 1.0 | 1.4 |
| 3.2 | 3.9 | 4.6 | 5.4 | .3 | .6 | 1.0 | 1.4 |
| 3.4 | 4.1 | 4.9 | 5.7 | .2 | .6 | 1.0 | 1.4 |
| 3.6 | 4.3 | 5.1 | 5.9 | .2 | .6 | 1.0 | 1.4 |
| 1.2 | 1.4 | 1.6 | 1.8 | 2.0 | 2.2 | 2.4 | 2.6 |
| 1.3 | 1.5 | 1.7 | 1.9 | 2.1 | 2.4 | 2.6 | 2.9 |
| 1.3 | 1.5 | 1.8 | 2.0 | 2.3 | 2.6 | 2.9 | 3.2 |
| 1.4 | 1.6 | 1.9 | 2.2 | 2.5 | 2.8 | 3.1 | 3.5 |
| 1.4 | 1.7 | 2.0 | 2.3 | 2.7 | 3.0 | 3.4 | 3.7 |
| 1.5 | 1.8 | 2.1 | 2.5 | 2.8 | 3.2 | 3.6 | 4.0 |
| 1.5 | 1.9 | 2.2 | 2.6 | 3.0 | 3.4 | 3.9 | 4.3 |
| 1.6 | 1.9 | 2.3 | 2.7 | 3.2 | 3.6 | 4.1 | 4.6 |
| 1.6 | 2.0 | 2.4 | 2.9 | 3.3 | 3.8 | 4.3 | 4.9 |
| 1.7 | 2.1 | 2.6 | 3.0 | 3.5 | 4.0 | 4.6 | 5.2 |
| 1.8 | 2.2 | 2.7 | 3.2 | 3.7 | 4.2 | 4.8 | 5.5 |
| 1.8 | 2.3 | 2.8 | 3.3 | 3.9 | 4.5 | 5.1 | 5.7 |
| 1.9 | 2.4 | 2.9 | 3.4 | 4.0 | 4.7 | 5.3 | 6.0 |
| 1.9 | 2.4 | 3.0 | 3.6 | 4.2 | 4.9 | 5.6 | 6.3 |
| 2.0 | 2.5 | 3.1 | 3.7 | 4.4 | 5.1 | 5.8 | 6.6 |

METHOD FOR TUNING MUSICAL INSTRUMENTS

CROSS REFERENCES TO RELATED APPLICATIONS

This is a continuation-in-part of Ser. No. 399,990, filed Sept. 24, 1973 (now abandoned) which, in turn, is a division of Ser. No. 249,942, filed May 3, 1972 (now abandoned).

BACKGROUND OF THE INVENTION

This invention generally relates to tuning musical instruments and more specifically to a novel method for tuning certain musical instruments.

Conventionally, a person tuning a musical instrument listens to a reference note and adjusts the instrument until its corresponding note seems consonant with the reference note. Consciously, or not, the person tunes a note for a specified beat rate, (which may be zero beat), with the reference note, usually at some harmonic of either one or both the notes.

This type of tuning is possible because an equally tempered scale is based upon simple mathematical relationships. In practice, however, pianos and other stringed instruments do not follow simple mathematical rules. In fact, piano tuners and builders use "harmonic" to denote a mathematical harmonic of a note and "partial" to denote the overtone which the string actually produces. The difference between a harmonic and a corresponding partial is caused by "stretch". Stretch is significant. In a piano, for instance, the second partial from a string may average 2.002 to 2.006 or more times the fundamental frequency (i.e., the first partial). Thus, if the fundamental notes are tuned mathematically, stretch causes the piano to sound out of tune.

Therefore, pianos and similar instruments must be tuned differently. Historically, a piano tuner uses a complex, iterative aural process in which he tries to reduce errors to a minimum step-by-step. Basically, he starts tuning a piano in a "temperament octave" by adjusting a first note to a reference frequency, usually provided by a tuning fork. He adjusts the remaining notes in the temperament octave by listening to partials of notes in third, fourth and fifth intervals. For example, in striking an interval of a third with a previously tuned lower note, the tuner adjusts the upper note while listening to the beat between the fifth partial of the lower note and the fourth partial of the upper note. He assumes the proper relationship exists when he hears a predetermined beat frequency.

Listening to these partials and beat frequencies reduces errors at the fundamental frequency because the partials multiply any error in terms of actual frequency differences. That is, a 4 Hz error at the forth partial represents only a 1 Hz error at the fundamental. Also, the use of partials inherently tends to compensate for piano stretch. However, the process is not perfect because the tuner's beat rates are calculated from harmonics rather than partials, and the tuner usually checks the temperament octave by retuning it using different intervals to minimize the tuning errors.

Once the tuner completes the temperament octave, he tunes other notes by comparing partials of notes at octave intervals. He may, for example, listen to the beat between the fouth partial of a lower, tuned note and the second partial of the upper note while adjusting string tension for the upper note. Lower notes are tuned similarly, although not necessarily with octave intervals.

Each note in a piano is sounded by striking two or three strings. During the foregoing procedure, the tuner damps out strings so only one string actually sounds when a hammer strikes all the strings associated with that note. After the tuner completes the procedure, he must tune the other strings for each note by comparing either the fundamental or partial frequencies of two strings associated with a given note.

As may be apparent, however, the entire procedure requires that a note sustain long enough to enable the tuner to determine the beat frequency. Obviously, the longer the interval the note sustains, the more accurately the tuner can determine the beat frequency. In tuning, each note struck sounds until it dies out naturally or the key is released. By "dying out", I mean that the note can no longer be heard. Thus, the time the note sustains limits the accuracy of aural tuning methods.

Although there are several tuning aids, no one aid has wide acceptance. In one, a high frequency oscillator produces an output clock signal at a selected frequency. A series of frequency dividers and an octave selector switch provide a means for generating a reference signal at a selected subharmonic frequency. The tuning aid combines this reference signal and a audio signal representing the note being tuned either to generate an audible beat note or to deflect a pointer on an indicating meter. Unfortunately, these aids lose accuracy as the tuned note comes into frequency with the reference. When the beat rate decreases below 20 Hz, the audible beat note becomes inaudible. Similarly, an indicating meter uses a frequency-to-current converter so the current level goes to zero at a zero beat. As the current approaches zero, the visual indication becomes less accurate. Both types of display, therefore, lose accuracy at the very time it is most necessary.

In another unit, the tuner attaches a piezoelectric transducer to a particular string or a sounding board to produce a corresponding electrical signal that is applied to the vertical deflection plates of a cathode ray tube. A selector switch, crystal controlled oscillator and a series of frequency dividers generate a selected reference signal which energizes the horizontal deflection plates of the tube. In using this circuit, one apparently assumes, erroneously, that a piano generates a constant, repetitive wave form. In fact, a piano string generates an extremely complex wave form comprising a fundamental tone and wide range of partials, often of the same magnitude, but slightly out of tune with each other. Furthermore, many of the component frequencies are not necessarily constant in magnitude because a string vibrates in many modes, each with its own damping constant. These factors cause the waveform to change continuously, so the display is difficult to interpret.

Another problem relates to dynamic response. Initially, the amplitude of the signal is sufficient to drive the display off the screen. As the tone dies out, the input to the vertical deflection plates falls below the minimum level necessary for generating a usable display. An obvious solution is installing a variable gain amplifier to maintain the output at a constant value. However, a circuit which provides satisfactory results over the wide range of conditions and waveforms which the piano generates is difficult to attain in practice. If the variable gain circuit actually tracks the decay, it may follow the wave-form and provide a dc output signal. Therefore, this solution is not practicable especially in view of the non-linear parameters or conditions and the short interval for a readable display. This effective dynamic range further complicates tuning because adjusting a string while monitoring the display is very difficult.

Still another tuning aid receives the audio signal from a piano and generates a corresponding electrical signal to energize the blanking or Z axis circuitry of a cathode ray tube. A circular generator energizes X and Y axis deflection plates with a reference frequency so the electron beam describes a circle on the screen. If a note is in tune with the reference, the audio signal blanks and unblanks the electron beam during the same part of each revolution to thereby display one arcuate segment. A second partial input signal produces two such arcuate segments; a third partial input signal, three segments; and so forth. If a given note is not exactly harmonically related to the reference, the segments rotate. The direction of rotation indicates whether the note is sharp or flat while the speed of rotation indicates the difference in frequencies. As notes in the upper piano produce a display with a number of segments, the spaces between adjacent sectors diminish; and the absolute frequency deviation which produces a persistent display tends to decrease. Furthermore, alternately blanking and unblanking the beam produces an indefinite segment termination on the screen. When the frequency deviation is small, the indefinite termination makes it difficult to determine whether the edges of the segments are moving. When notes in the lower range of the piano are tuned, the tuner must try to adjust while the tuning aid responds to partials, since subharmonics of the reference frequency generate complete circles on screens.

A tuning aid must provide some means for stretch compensation when it is used to tune a piano. Thus, numerous tests have been made to evolve standard tuning curves which provide stretch compensation. These curves are derived by aurally tuning a large number of pianos. The measured frequencies of the aurally tuned notes are then combined to produce average frequencies from which one curve, or at most a limited finite set of curves, are drawn. These curves are unsatisfactory, however, because the actual frequencies are distributed around the average. Thus, if an aurally tuned piano is made to conform to the standard curve, it is, by definition, detuned. Thus, this unique quality of a given piano, i.e., its stretch, which results from its construction, string-length, and myriad other factors, has made the tuning aids practically unworkable in many cases. As a result, the best piano tuners have continued to work conventionally and do not place any significant reliance on these tuning aids.

Therefore, it is an object of this invention to provide a new method for tuning a piano which takes into account the stretch characteristic for that piano.

Another object of this invention is to provide a new method for tuning a piano which enables the use of mechanical aids.

Another objct of this invention is to provide a tuning aid which is readily adapted for tuning a wide variety of instruments.

SUMMARY

In accordance with this invention, a tuner first uses an electronic tuning aid to measure the characteristic stretch of the piano. This is done by comparing a measured partial frequency with the frequency of a mathematical harmonic. Then, the tuner adjusts one reference note on the piano so its fundamental is at a predetermined standard frequency. Each successive note is tuned to a different tuning frequency which is the sum of the nominal frequency for that note and a deviation frequency which is calculated for that note dependent upon the characteristic stretch of that piano. This provides a repeatable tuning method for tuning a piano to a tuning curve which is characteristic of that piano.

This invention is pointed out with particularity in the appended claims. A more thorough understanding of the above and further objects and advantages of this invention may be attained by referring to the following description taken in conjunction with the accompanying drawings.

BRIEF DESCRIPTION OF THE DRAWINGS

FIG. 5, comprising

DESCRIPTION OF AN ILLUSTRATIVE EMBODIMENT

1. General Discussion

Figure 1:
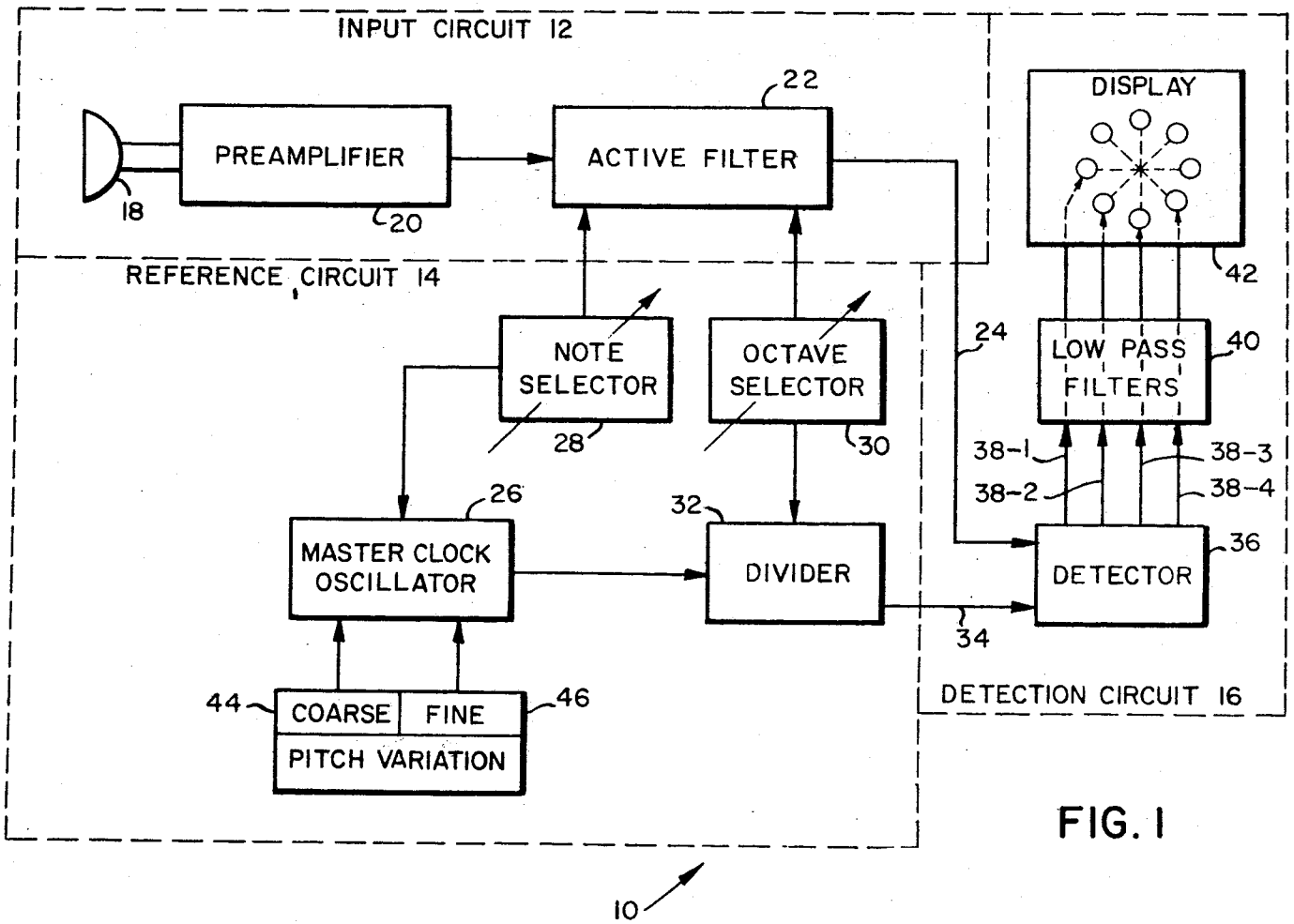
FIG. 1 is a block diagram of a tuning aid adapted for use with this invention.
Figure 7:
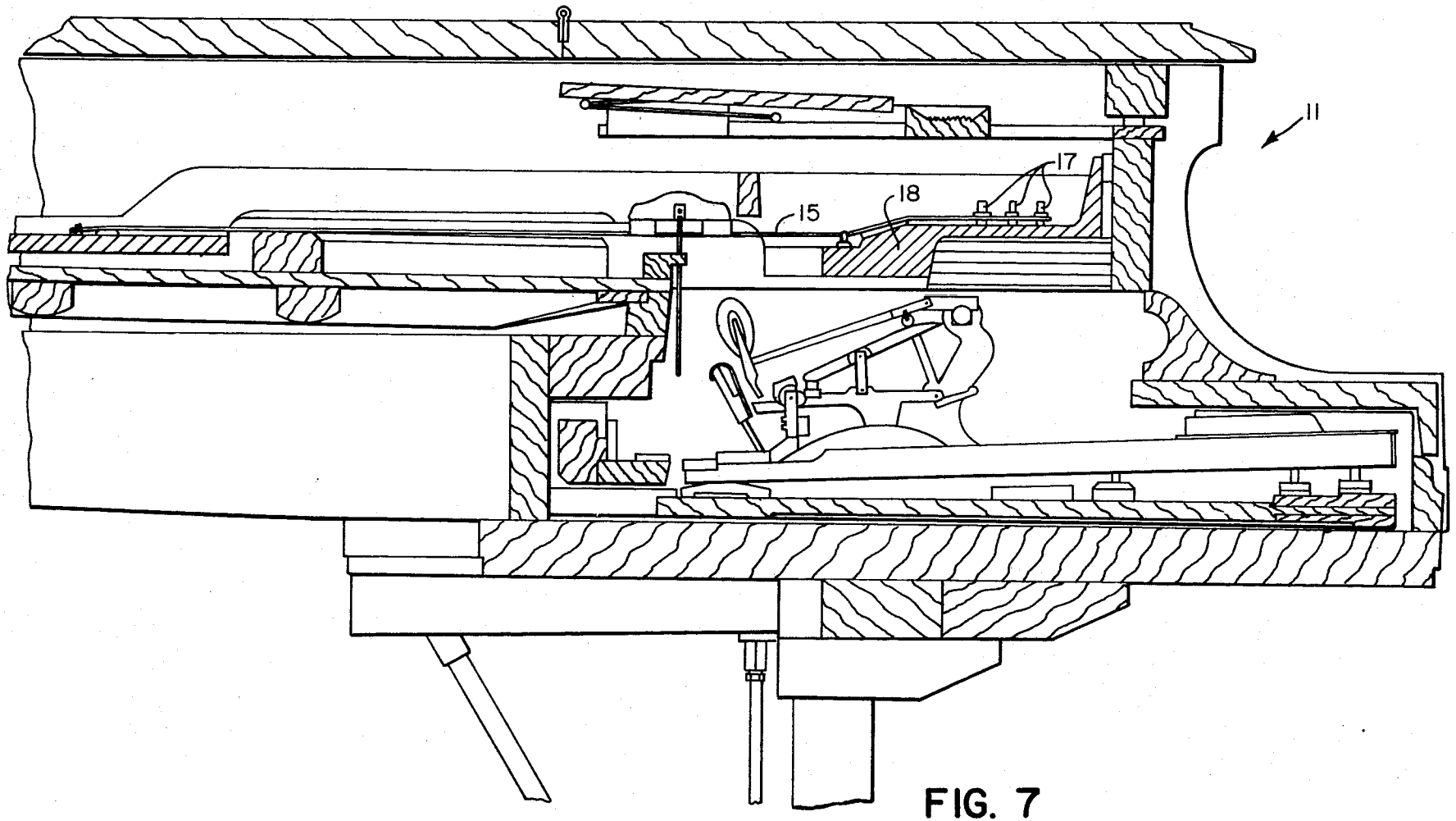
FIG. 7 is a perspective view, partly in section, of a piano.

As shown in FIG. 1, my tuning aid 10 comprises an input circuit 12, a reference circuit 14 and a detection circuit 16. The input circuit 12 comprises a microphone 18 which picks up signals generated as a musical instrument, such as piano 11 of FIG. 7 is tuned. For example, on piano 11, it detects the sound emanating from a struck tone generator 13, each of which comprises one or more strings 15. The tension of strings 15 is adjustable by tuning pins 17 in a pin block 18 thereby to vary the tension on the string and tune the string to a given frequency. A conventional preamplifier 20 and an active filter 22 in tuning aid 10 of FIG. 1 isolate the signal being tuned from other signals which the microphone 18 senses. The active filter 22 preferably is a tunable bandpass filter which has a quality factor greater than ten. It produces an audio output signal on a conductor 24 which connects to the detection circuit 16.

The reference circuit 14 produces a second input signal to the detection circuit 16. A variable frequency master clock oscillator 26 covers the twelve notes two octaves above the highest octave to be tuned, for purposes which will become apparent later. A particular oscillator frequency is selected by a note selector 28 which simultaneously tunes the active filter 22. An octave selector 30 also controls the active filter 22 and further controls a frequency divider 32 which, in response to the signals from the master clock oscillator 26, provides a square wave output signal which is twice the frequency determined by the note selector 28 and octave selector 30. That is, if the selectors 28 and 30 are set to select a musical A at 440 Hz while the master clock oscillator 26 generates a 28.16 kHz output an 880 Hz signal appears on the conductor 34 leading from the divider 32.

The detection circuit 16 has a detector 36 which receives both the audio signal on the conductor 24 and the reference signal on the conductor 34. It generates four output signals on output conductors 38-1, 38-2, 38-3 and 38-4. Each output is a constant-amplitude, pulse-width-modulated signal with pulse width varying as a function of the phase difference between a note signal on the conductor 24 derived from the instrument being tuned and a reference signal on the conductor 34, which is the output from the clock divider 32. The pulse repetition rate is equal to the selected reference frequency and the rate at which the pulse width changes on each conductor depends on the frequency difference between the note frequency and one-half the reference frequency, the pulses on each conductor having unvarying width if the struck note is in tune with the reference. Low-pass filters 40 couple the pulse signals from the detector 36 to a display 42. At any given time, a filtered dc output from a low pass filter is proportional to the width of an input pulse. If there is a frequency deviation, each low-pass filter output varies from 0% to 200% of its normal value at a rate which is proportional to the frequency difference.

The display unit 42 preferably contains one pair of lamps (e.g., light-emitting diodes) energized by each low-pass filter output. Mechanically, each lamp in a pair may be diametrically opposed in a circle, with adjacent lamp pairs separated by 45°. As becomes apparent later, the signals which energize the lamps are in spaced quadrature, but 180° out of phase electrically. If a first lamp pair is at full brilliance, a second lamp pair, displaced 90° from the first, is off. The lamp pairs that are displaced ±45° from the first are also off, for reasons I discuss later.

When an incoming note is in tune, one pair of lamps may be at or nearly at full brilliance or two pairs may be partially lit. However, the relative brilliance of the lamps does not change. As a result, the display appears stationary. If there is a frequency deviation, the individual lamp pairs reach full brilliance in one of two sequences. If the note is "sharp" (i.e., at a higher frequency than the reference), then the lamps reach full brilliance in a clockwise sequence; so the display appears to rotate clockwise. When a note is flat, the sequence is reversed and the display appears to rotate counterclockwise. As the repetition rate at which a given set of lamps reaches full brilliance depends upon the frequency difference, the rate at which the display appears to rotate indicates the magnitude of the deviation.

2. Specific Discussion

The heart of the tuning aid is in the manner in which the detector 36 and low-pass filters 40 condition input signals and display the results. Still referring to FIG. 1, the signal that the master clock oscillator 26 and the divider 32 place on conductor 34 has twice the frequency of the selected note. Division by at least two in the divider 32 means that the outputs from the master clock oscillator 26 must be four times the highest frequencies to be measured. In one specific embodiment using a "C" as a lower octave limit and a "B" as an upper limit, the master clock oscillator 26 generates nominal signals in the range between 16744 and 31609 Hz. Depending on the setting of the octave selector 30, the clock divider 32 divides the oscillator output by a factor of $2^n$ where $1<n<8$. When the octave selector 30 is set for the highest octave, the divider 32 divides the oscillator frequency by 2, while a division by 256 occurs when the octave selector 30 is set for the lowest octave. As a specific example, setting the note selector 28 to "A" causes the oscillator 26 to generate a 28160 Hz signal. The frequency of the signal on the conductor 34 and the frequency which the tuning aid will sense are then as follows:

| Octave Number | Signal on Conductor 34 | Frequency of Signal Being Measured |
|---|---|---|
| 8 | 14,080 | 7,040 |
| 7 | 7,040 | 3,520 |
| 6 | 3,520 | 1,760 |
| 5 | 1,760 | 880 |
| 4 | 880 | 440 |
| 3 | 440 | 220 |
| 2 | 220 | 110 |
| 1 | 110 | 55 |

a. Detection Circuit 16

Figure 2:
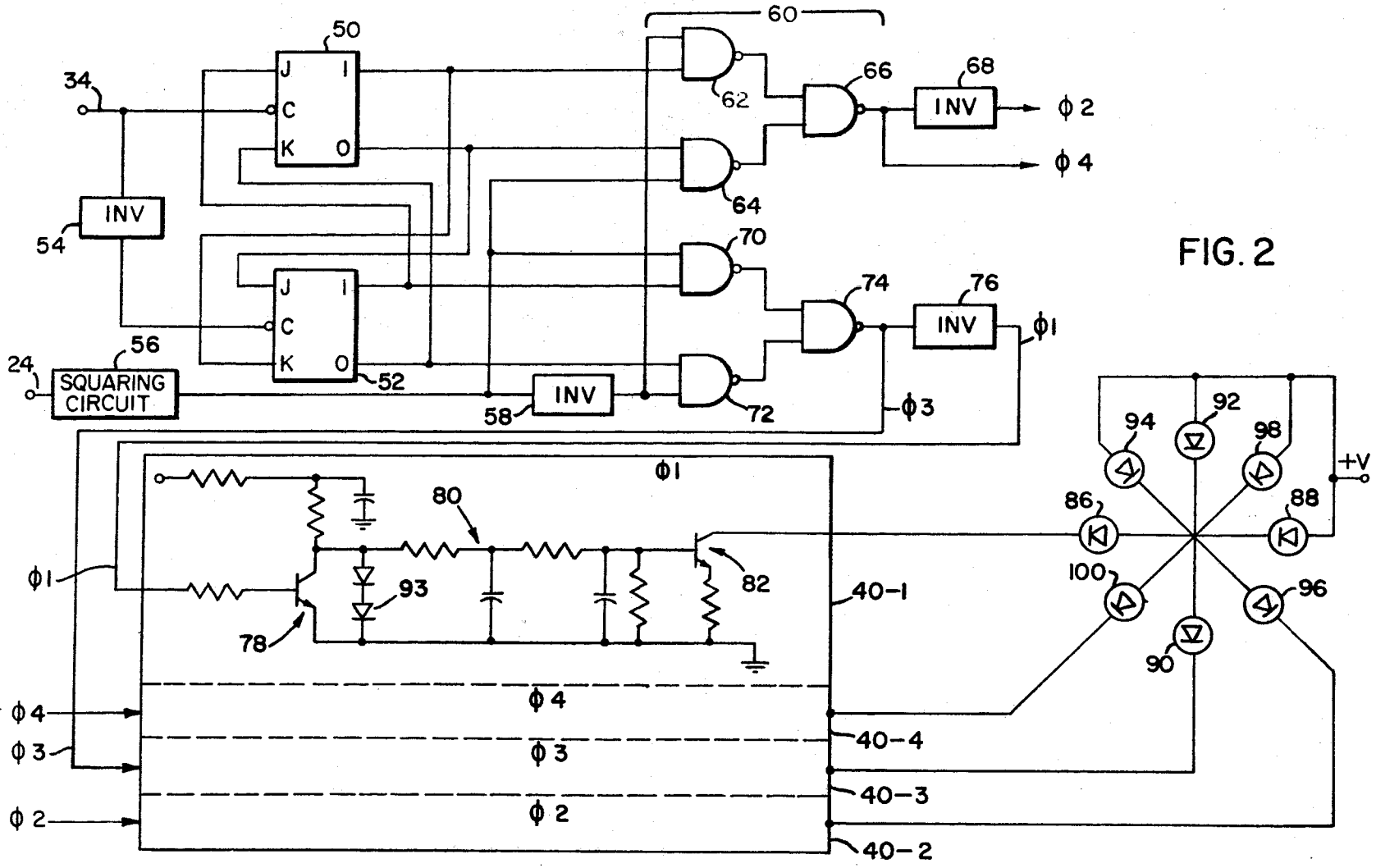
FIG. 2 is a circuit schematic which illustrates certain details of the circuit shown in FIG. 1.

Now referring to FIG. 2, the signal on conductor 34 energizes the inverting clocking terminals of JK flip-flops 50 and 52, the latter clocking input receiving its signal through an inverter 54. The nature of the cross-coupling shown in FIG. 2 determines the flip-flop response to clocking signals. In this particular embodiment, the JK flip-flops 50 and 52 are cross-coupled so the set (1) and reset (0) output terminals of the JK flip-flop 50 energize the K and J input terminals of the JK flip-flop 52, respectively. The set (1) and reset (0) output terminals of the JK flip-flop 52 connect to the J and K input terminals of the flip-flop 50, respectively.

Figure 3:
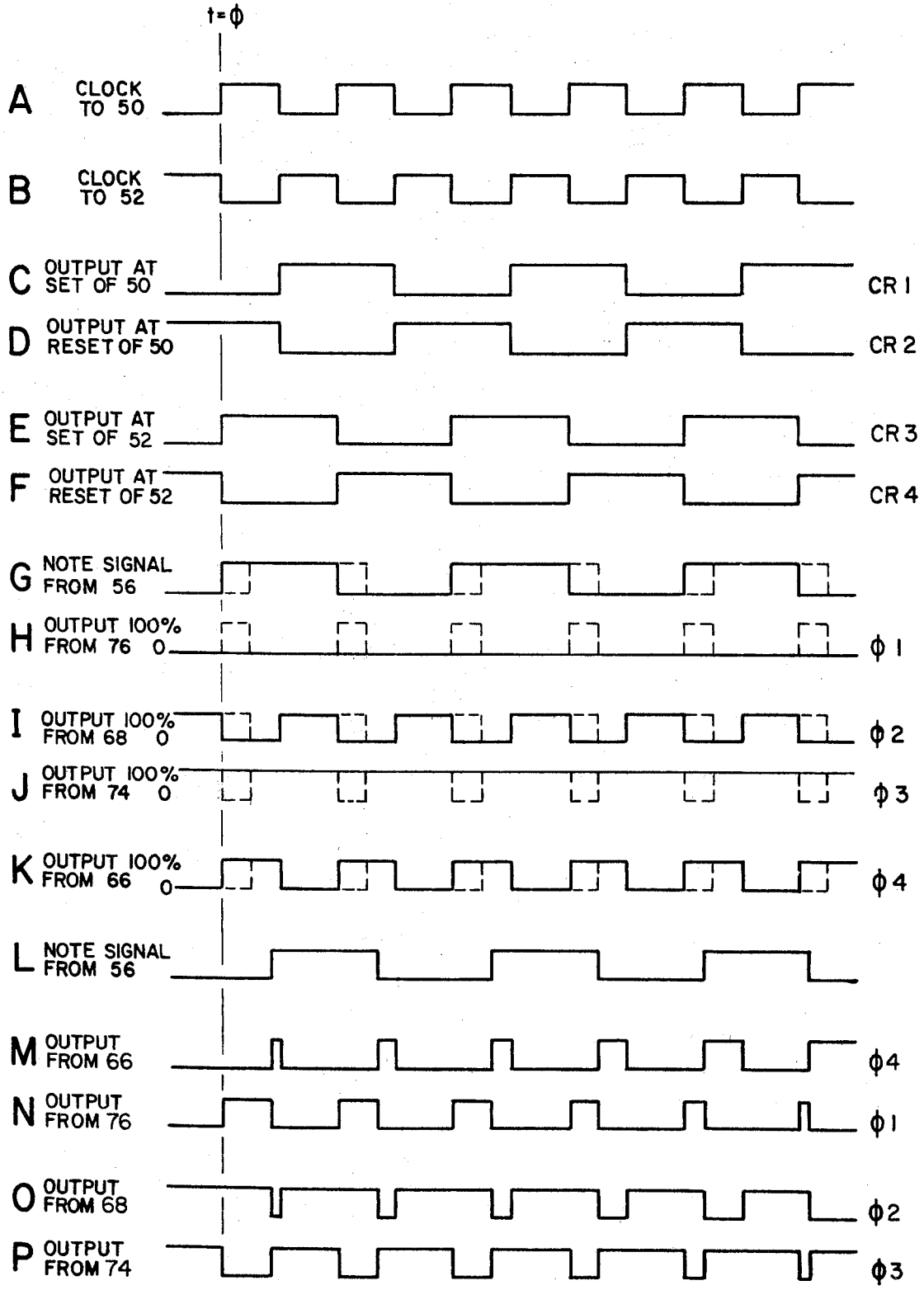
FIG. 3 is a graphical analysis of the operation of a portion of a circuit shown in FIG. 1.

Now referring to FIG. 3, GRAPH A represents the clocking signal, a square wave that energizes the JK flip-flop 50 while Graph B is a timing chart for the complementary clocking signal to the flip-flop 52 from the inverter 54. Assuming for a moment that at $t=0$, the clocking signal to the flip-flop 52 falls while both the flip-flops 50 and 52 are reset, the trailing edge of the complementary clocking signal sets the flip-flop 52 and generates a clock reference signal designated as CR3 and a complement CR4 signal as shown in GRAPHS E and F. Next, the trailing edge of the clocking signal sets the flip-flop 50, which generates the CR1 and CR2 signals as shown in GRAPHS C and D. A succeeding clocking signal to the flip-flop 52 resets it (GRAPHS E and F). This conditions the flip-flop 50 to be reset by the trailing edge of its next clocking signal. As a result, it takes two cycles of the clocking signal from the conductor 34 to cycle each CR signal from the flip-flops 50 and 52. This additional frequency division means the four CR signals from the flip-flops 50 and 52 are at the selected frequency. As also apparent, the CR signals are in quadrature. Looking at the positive-going pulse edges, the sequence is CR3-CR1-CR4-CR2, the leading edge of each pulse being spaced 90° in phase from the leading edges of preceding and following pulses. Hence, the outputs of flip-flops 50 and 52 constitute a four-phase set of reference signals.

GRAPH G depicts a note signal after the signal in the conductor 24 is conditioned in a conventional squaring circuit 56 in FIG. 2. In this particular example, the note is in tune with the reference selected frequency and the signal in solid lines is in phase with the CR3 signal. In addition, an inverter 58 produces a complementary note signal which is in phase with the CR4 signal.

Referring to FIGS. 2 and 3, the four-phase clock reference and the note signals energize a phase modulator circuit 60 comprising two exclusive OR circuits. The first exclusive OR circuit comprise NAND circuits 62, 64 and 66; the second, NAND circuits 70, 72 and 74. The output from a NAND circuit 66 is designated as the "$\phi$4" output; the complementary "$\phi$2" output comes from the inverter 68. There are two conditions which cause the $\phi$4 signal to be at a zero level representing a FALSE output from the exclusive OR circuit;

1. the note signal is positive and CR1 is positive, or
2. the note signal is zero and CR1 is zero. Otherwise the $\phi$4 signal is at a ONE level indicating that the exclusive OR function is met. Similarly, the $\phi$3 signal is zero when:
1. the note signal is positive and CR4 is positive, or
2. the note signal is zero and CR4 is zero. Otherwise, the $\phi$3 signal is at a ONE level. Therefore, the $\phi$4 output signal indicates whether the CR1 signal (the set condition of the flip-flop 50) and set condition of the note signal satisfy an exclusive OR condition. Similarly, the $\phi$1, $\phi$2, and $\phi$3 signals indicate the exclusive OR condition of the note signal and each of the CR3, CR2 and CR4 signals, respectively.

Still referring to FIGS. 2 and 3 and considering the note signal shown by the solid line in GRAPH G, the note signal and set output from the flip-flop 52 are exactly in phase. Either the NAND circuit 70 or 72 keeps the $\phi$3 output signal at a positive or logic 1 value, so the $\phi$3 signal has a 100% duty cycle. Obviously, the $\phi$1 output signal is always at a logic zero or a minimum value and has a 0% duty cycle. On the other hand, the necessary conditions to shift the $\phi$4 output signal to a positive state exist 50% of the time, so the $\phi$4 and $\phi$2 output signals are complementary pulse trains at twice the selected frequency and each has a 50% duty cycle.

Now referring back to FIG. 2, each phase output signal is passed through one of four identical low-pass filter circuits 40, a $\phi$1 filter circuit 40–1 being shown in detail. A switching circuit 78 together with diodes 93 responsive to the $\phi$1 output signal provides a constant amplitude, variable width pulse input to a conventional two-section RC low-pass filter 80. The low-pass filter 80 normally varies its output voltage as a function of the duty cycle to control a non-linear lamp amplifier 82 which, in turn, energizes light-emitting diodes 86 and 88.

In the particular situation shown by GRAPH G in FIG. 3, the $\phi$1 output signal (graph H is constant at zero (a 0% duty cycle). This places a maximum positive voltage on the base electrode of the transistor amplifier 82, so the amplifier 82 keeps the diodes 86 and 88 on; and they generate a maximum light output. However, the $\phi$3 output signal (GRAPH J) and the output of the $\phi$3 filter circuit 40-3 are at maximum and minimum levels, respectively, so diodes 90 and 92 are turned off.

On the other hand, the $\phi$2 and $\phi$4 output signals (GRAPHS I and K) have a 50% duty cycle. In order to enhance the display, the filters are constructed so the lamps in a pair do not light until the duty cycle of an output signal falls below some threshold representing a duty cycle less than 50%. Specifically, the diodes 93 in the switching circuit 78 clip the input signal to a value which equals the forward breakdown voltage of two diodes (i.e., about 1.2 volts total with silicon diodes). The lowpass filter 80 is constructed so that at approximately a 50% duty cycle, the filter output cannot forward bias the base-emitter junction of the amplifier 82 so the light-emitting diodes the amplifier controls do not conduct. When the duty cycle reaches a value which causes the filter output to forward bias the base-emitter junction, the amplifier 82 turns on and the corresponding diodes conduct whereupon the diodes emit light at a level which is proportional to the current through the amplifier.

If the note signal shown in GRAPH G merely shifts slightly in phase, without changing frequency, as shown by the dotted lines, the $\phi$1 output signal no longer as a 0% duty cycle signal. Hence, the energizing current through the diodes 86 and 88, which responds to the duty cycle for the $\phi$1 output signal, decreases. If the phase-shift is to the right as shown by the dashed lines in GRAPH G, the $\phi$2 output signal duty cycle increases, so diodes 94 and 96 remain off. In this particular case, the $\phi$3 duty cycle decreases, but remains above a 50% duty cycle, so the diodes 90 and 92 also remain off. However, the $\phi$4 signal has a duty cycle which is less than 50% so the diodes 98 and 100 turn on slightly.

GRAPH L shows the signal from the squaring circuit 56 when the note signal frequency is greater than the standard frequency. GRAPHS C through F and L show that each output signal duty cycle varies in time. For the time interval shown, it is apparent from GRAPH M that the $\phi$4 duty cycle is increasing from a minimum. Meanwhile, the duty cycle of the $\phi$2 output signal (GRAPH O) is decreasing from a maximum. As time continues, the $\phi$4 output signal will reach a maximum duty cycle and then return to a minimum; and the variation is substantially linear with time. Similarly, the duty cycle of $\phi$1 output signal (GRAPH N) is decreasing from 50% while the $\phi$3 output signal (GRAPH P) is increasing from 50%. As a result, the light output from diodes 98 and 100 decreases while diodes 86 and 88 turn on with their brightness increasing as the $\phi$1 signal and duty cycle continues to decrease.

Furthermore, the light output from diodes 98 and 100 continues to decrease until the threshold is reached, whereupon they turn off. At about the time they reach one-half brilliance, however, the output from the filter circuit 40-2 will have reached the same value, so that diodes 94 and 96 will also be at about half brilliance. When the diodes 94 and 96 reach full brilliance, the tuner sees what appears to have been a rotation of a light bar 45° clockwise and this apparent rotation continues, so that the display appears as a bar which rotates at one-half the beat frequency.

When the beat frequency exceeds about 5Hz, the display is persistent to the eye. However, at this beat frequency, each low-pass filter begins to attenuate its output so the maximum current level, and the average energy level to the lamps, decreases. This reduces the average brilliance of the lamps. So when the display is persistent, the tuner adjusts a string to increase brilliance. At about 25 Hz, there is enough filter attenuation to turn all the lamps off. This poses no problem, however, because a 25 Hz difference is readily detectable by ear. At the low end of the piano, it represents an octave while at the high end of the piano it represents a tuning error of 10% of a semitone. It is apparent that the individual input pulses of each of the filter circuits, such as the filter 80 in filter circuit 40-1, do not affect, directly, the light emitting diodes. This is because the pulses themselves are at the clock frequency and the minimum clock frequency is greater than the cut-off frequency of the low pass filters.

b. Master Clock Oscillator 26

For the tuning aid to be effective, there should be some provision to vary the frequency of the master clock oscillator 26 shown in FIG. 1. The oscillator 26 generates signals in accordance with the known mathematical relationships of the equally tempered scale. Course and fine pitch variation controls 44 and 46 (FIG. 1) enable a tuner to vary the frequency of all the notes up to ½ a semi-tone in either direction, while preserving the correct relationship among the notes.

Figure 4:
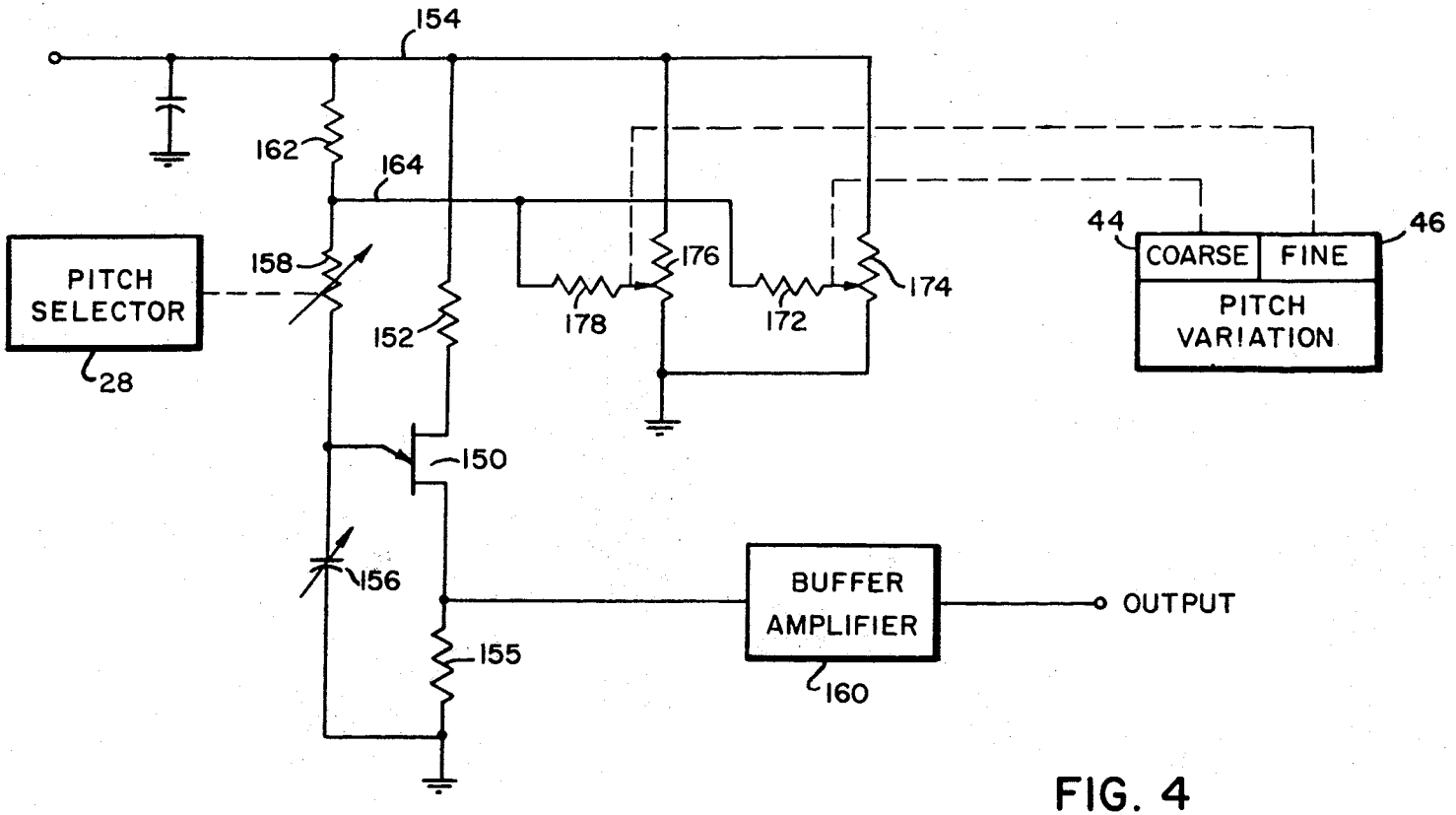
FIG. 4 is a detailed schematic of another portion of the circuit shown in FIG. 1.

As shown in FIG. 4, the master clock oscillator 26 comprises a unijunction transistor 150 in a relaxation oscillator circuit. A temperature-compensating resistor 152 connects "base 2" to a conductor 154 from a power supply. An output resistor 155 is between "base 1" and ground. Two elements generally control the oscillator frequency — a variable capacitor 156 and a variable resistor 158.

To set the oscillator initially, the capacitor 156 is adjusted so that the oscillator 26 generates its highest required frequency. This is done with the resistor 158 at a minimum value. Usually the resistor 158 comprises a switched resistance ladder network which enables the frequency for each setting of the note selector 28 to be adjusted independently. During calibration, the frequencies are adjusted for the correct mathematical relationship. A buffer amplifier 160 couples the signal from the output resistor 155.

The capacitor 156 and resistor 158 constitute two distinct means for varying the frequency of the oscillator 26. The oscillator 26 includes a third means for independently varying frequency. As known, the unijunction transistor 150 discharges when the emitter voltage reaches a threshold which is a substantially constant percentage of the voltage between the bases. The time is takes the capacitor voltage to reach that threshold is a function of the resistor and capacitor values and the voltage applied to the tuning circuit.

In the oscillator 26 in FIG. 4, this voltage appears across a capacitor 166 and is equal to the voltage on the conductor 154 minus the voltage across a resistor 162. The voltage across the resistor 162 depends on the current through it and the current has two components. A first component is constant for a given setting of the note selector 28 and depends upon the voltage on the conductor 154 and the series impedance of the resistors 162 and 158.

The second component is variable in response to the setting of the pitch controls. A conductor 164 carries this second component. As the pitch controls increase this component, the voltage drop across resistor 162 increases so the voltage across capacitor 156 decreases. As a result, the oscillator frequency decreases.

The remaining circuitry shown in FIG. 4 provides the variable second current component. A first resistor network comprising a resistor 172 couples the conductor 164 to the wiper of a potentiometer 174, the potentiometer 174 being energized from the conductor 154. Variations in the position of the coarse pitch control 44 offset the wiper arm from a normal position. Positioning the fine pitch control 46 similarly alters the wiper arm on a potentiometer 176 also energized from the conductor 154. A resistor 178 couples this wiper arm to the conductor 164.

The qualitative effect of varying either wiper arm position is the same. The component values are chosen so that a given physical displacement of the coarse pitch control 44 produces a larger offset than the same displacement of the fine pitch control 46. Therefore, the following discussion relates only to the operation of the coarse pitch control 44.

Two relationships exist in this circuit. First, as apparent, the voltage on the conductor 154 is greater than the voltage on the conductor 164. Secondly, resistor 172 is at least an order of magnitude larger than resistor 162.

At a zero voltage offset position, there is a zero voltage drop across the resistor 172 so only the first current component flows through the resistor 162. If the coarse pitch control 44 is moved, the second current component from the conductor 164 changes the voltage across the resistor 162 and the capacitor 156.

Both pitch controls vary the frequency as a percentage of the base frequency, so these controls can be calibrated in "cents" difference to raise or lower the resulting frequency, assuming that the oscillator is calibrated with the potentiometers 174 and 176 at their mid-points.

The tuning aid shown in FIG. 1 is sensitive and accurate. Tests show that the display has visible motion when the phase shift is less than 10°, with the accuracy being dependent upon the time the tuning aid senses the tone and the stability of both the tone and note. This means that the tuning aid senses a frequency difference which produces less than a 10° phase shift over the interval the note signal exists. When operated from a battery power supply, the tuning aid is very stable. Tests against a tuning fork show no displacement after 10 seconds of tone. This increased sensitivity and stability have enabled me to analyze how pianos are tuned conventionally and evolve two new ways to tune a piano.

c. Tuning Methods

Piano tuners use different tests as they tune a piano to compensate for stretch. Each tuner, however, uses the same tests as he tunes each piano. Generally, therefore, the frequency deviation of a given note from its theoretical value after it is tuned is rather consistent from one piano to another and repeatable as to a given piano. With my tuning aid, a tuner could determine the curve for each piano after he tunes it and then use the tuning aid and curve when later retuning the piano. Different curves are necessary because each piano has a characteristic stretch that is unique.

i. Temperament Octave - Linear Apportionment Method

In accordance with this invention, I am able to tune each piano to one of several custom tuning curves. Normally, a tuner starts with a reference note (e.g., 440 Hz from a tuning fork or like unit). With one of my methods, which I call a linear apportionment method, the tuner calibrates the tuning aid with this reference note and adjusts the pitch controls until the display is stationary. Then he adjusts the string tension for the same note in the lower octave [e.g., an A (220) note] until its harmonic is at the reference frequency. If the tuner then adjusts the octave selector to the next lower octave and the pitch controls to stabilize the display, the pitch control movement indicates the characteristic stretch for the temperament octave of that piano.

Now the temperament octave is tuned by apportioning the stretch equally over the 12 semi-tone intervals. That is, if the lower note is considered to be in tune and the piano has the characteristic stretch of 4 cents (4% of a semitone), the next higher semi-tone is set one-third of a cent sharp and each successive semi-tone is set sharp by an additional one-third of a cent. These small variations are easily obtained with my tuning aid because the per cent change in frequency of a given note varies linearly as the angle of rotation of the potentiometer shaft. In one embodiment, for example, it is possible to set the pitch control 46 to within 0.1 cent.

ii. Octave Tuning

Once the temperament octave has been tuned, successive notes in the octave or in other octaves are also tuned. Generally, having the tuned A(220) and A(440), for example, one might tune the A(880), A(1760) and A(3520) notes in succession. The A(880) note may then be tuned by setting the tuning aid to monitor an A(1760) note and calibrating it to the fourth partial of the A(440) note. The A(880) note is then tuned for zero display deflection. When this occurs, the fourth harmonic of the A(440) note and the second partial of the A(880) note are in tune. As a tuner moves up the scale, he reaches a point at which the fourth partial are very weak. At this point, the procedure is modified by tuning a note [e.g., an A(3520) note] after the tuning aid has been calibrated to the second partial of a lower note [e.g., an A(1760)]. This procedure assures that each note is tuned with just the right amount of stretch to make octave intervals sound in tune.

For lower octaves, I calibrate the tuning aid to the second partial of a tuned note and then adjust the lower octave note, thereby comparing the second and fourth partial. As the tuner reaches lower notes, the strings generate less fundamental output. However, third, fourth, sixth and eighth partials become strong. Therefore, in the low bass a tuner may elect to use the tuning aid to align the fourth partial of a previously tuned note and the eighth partial of the note being tuned. Again, this procedure stretches the octaves by just the amount necessary for them to sound in tune.

Third and sixth partial may also be used. In this case, to adjust an A(55) note, the tuner sets the tuning aid to E(330), calibrates it to a tuned A(110) note and adjusts the A (55) note. In this manner, the tuner compares the sixth partial of the A(55) note and the third partial of the A(110) note.

Thus, it will be apparent that the foregoing method for tuning a piano can be accomplished with the described tuning aid or other aids having the requisite sensitivity and accuracy. A piano has a pleasing sound when it is tuned according to this method, but the sound can be improved further by deviating from a strictly linear apportionment over the temperament octave. For example, the deviation for each note might be increased at the upper end of the temperament octave and decreased for notes at the lower end of the octave so that the corresponding total accumulated deviation corresponds to the measured stretch. The best sound is attained when such changes are made smoothly.

3. Temperament Octave-Mathematical Method

It was during experiments and tests made on various pianos tuned both in accordance with this method and aural methods by good piano tuners that I found still another method for tuning a piano which meets the most critical tuning tests. This method provides tuning in accordance with a mathematical curve which applies specifically to any piano which is being tuned. The curve was derived by analyzing the actual frequencies of various partials for each note in several pianos. Several analyses of the "inharmonicity" (i.e., the difference between the frequency of a partial and the frequency of the corresponding harmonic of a note on an equally tempered scale) were made for each piano. I found that, over a major portion of the pianos comprising notes C3 through C8, which includes all the normally tuned temperament octaves comprising the notes C3 through A4, there is a mathematical relationship that can be defined generally as:

$$B_0(N) = [B_0]\,[2^{(N-N_0)/K_1}] \qquad 1.$$

where B(N) is an inharmonicity factor in cents for the fundamental or first partial, of any note; $B_0$ is the inharmonicity for a reference note; N is a note number, which is an integer number assigned to each note in sequence from N=1 for A0 through N=88 for C8; $N_0$ is the note number for the reference note; and K1 is a slope factor, which represents the number of notes over which the inharmonicity factor B(N) doubles.

It is also known that the inharmonicity, I(n,N), for any partial of a given note is given by $$I(n,N) = n^2\,B(N) \qquad 2.$$

where $n$ is the partial for which the inharmonicity is being determined.

It is necessary for any valid tuning method to satisfy the inharmonicity formula, formula (1) and to maintain tuned octaves. A mathematical analysis of these requirements yields the following tuning formula for the deviation, Y(n,N), for all partials of each note as a percentage of a semi-tone:

$$Y(n,N) = B_0[n^2 + K_2)\,2^{(N-N_0)/K_1-1-K_2}] \qquad 3.$$

wherein $K_2$ is an octave matching constant. Formula (3) satisfies the foregoing criteria.

The slope factor $K_1$, has been measured for a number of different pianos. It varies between "6" and "10" for good pianos and $K_1$=8.3 is generally a good value for this constant. Given this value, it is possible to use formula (3) to determine $K_2$. Under the condition that the second and fourth partials be in tune and with $K_1$= 8.3, $$Y(4, N) = Y(2,N+12) \qquad 4.$$

and the octave matching factor is:

$$K_2 = 4(4-2^{12/K_1})/(2^{12/K_1}-1) \cong 3 \qquad 5.$$

Likewise, using $K_1 = 8.3$ and using the constraint that the first and second partials be in tune:

$$Y(2,N) = Y(1,N+12) \qquad 6.$$

and the octave matching factor is:

$$K_2 = (4-2^{12/K_1})/(2^{12/K_1}-1) \cong 0.75 \qquad 7.$$

With these values, formula (3) can be used to calculate the deviation frequency for each note and each partial thereof for different values of characteristic stretch (i.e., values of $B_0$). This provides a different apportionment from the linear apportionment method, as formula (3) contains an exponential term. Formula (3) can be used to tune a temperament octave, using the $K_2 = 3$ octave matching factor by monitoring the fourth partials and tuning the remaining notes in accordance with the previously described octave tuning method. With formula (3), all the notes from C3 through C8 can be tuned, however, by the octave tuning method with equal accuracy. The octave tuning method may also be used to time notes below C3.

Pianos tuned according to this method provide generally satisfactory sounds to critical piano tuners and artists. However, I have found that the best tuning of pianos occurs when formula (3) is modified further so that the octave is stretched beyond normal. An "overstretch", which produces a beat frequency at about 0.5 beats per second in accordance with the octave tuning method, provides the best results. If the measured characteristic stretch is 6 cents, then according to my method the formula (3) should be modified so that the total stretch of the temperament octave produces this beat frequency. This can be done simply by adding a term to formula (3) to yield;

$$Y'(n,N) = Y(n,N) + a[1-2^{(N_0-N)/12}] \qquad 8.$$

wherein $Y'(n,N)$ is the deviation for any note or partial thereof to obtain an overstretched octave and $a$ is a constant for controlling the beat rate of the overstretched octave. A value $a=1$ provides the half-beat rate for $N_0 = 49$.

Formula (8) also is used for tuning notes from C3 through F6. Notes below C3 may or may not follow formula (1). Further, formula (8) can be easily used to calculate the deviation frequency for any given note and partial if the characteristic stretch, which determines the value of $B_0$ in formula (8) and values of $K_1$ and $K_2$ are known. Also I have found that improved results are obtained when $K_2 = 3$ is used for notes C3 through F4 while $K_2 = 0.75$ is used for notes F # 4 through C7.

FIG. 5 shows a tuning calculator which provides deviations for the notes from C3 through F6 in accordance with formula (8). The deviation and characteristic stretch numbers are printed on a card 200. One column of numbers corresponds to the characteristic stretch numbers and the remaining numbers constitute an array formed in columns, along an axis, and rows. Each column, or portion of a column, corresponds to a partial for a given note while each row corresponds to the deviation for a given characteristic stretch.

The card 200 is slidably retained in a jacket 201 for longitudinal motion in the jacket along the column axis. Jacket 201 also contains a window 202 for displaying a stretch number while the other numbers in the array appear at discrete positions in other transverse windows 203, 204 and 205. At each of these other window positions, a designation above the window indicates the note to be tuned while a designation below the window represents the partial which should be used in setting the note. The number between them is the deviation in cents. Thus, at position 206, the note C3, which has a nominal or mathematical frequency of 130.81 Hz, is to be offset until its fourth partial is 4.9 cents flat from the nominal C5 frequency. This means that the fourth partial should be tuned to 521.77 Hz rather than 523.25 Hz.

Figure 5A:
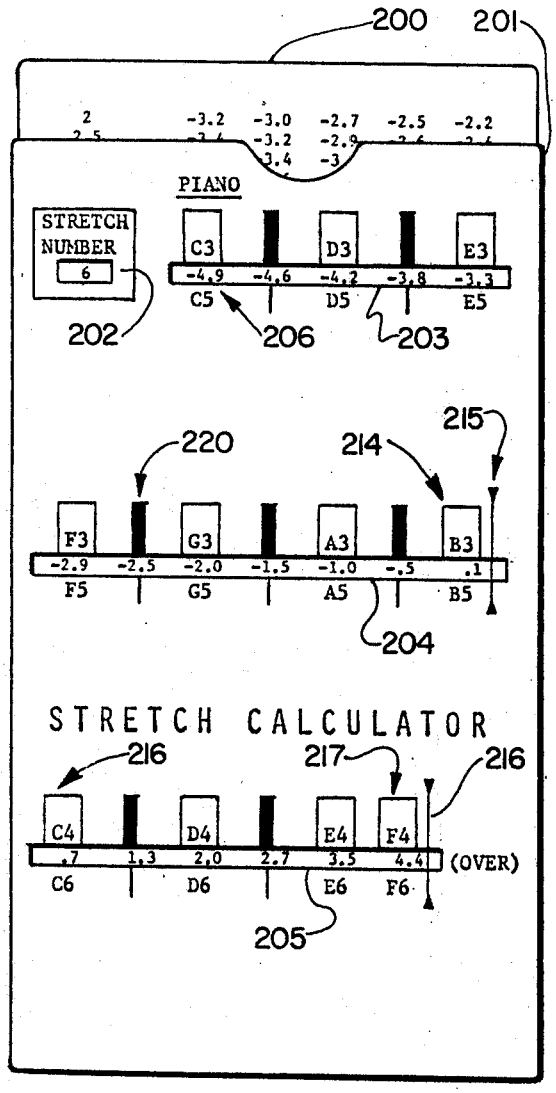
FIGS. 5A and 5B, depicts a device for specifying frequencies for successive notes in a piano.
Figure 5B:
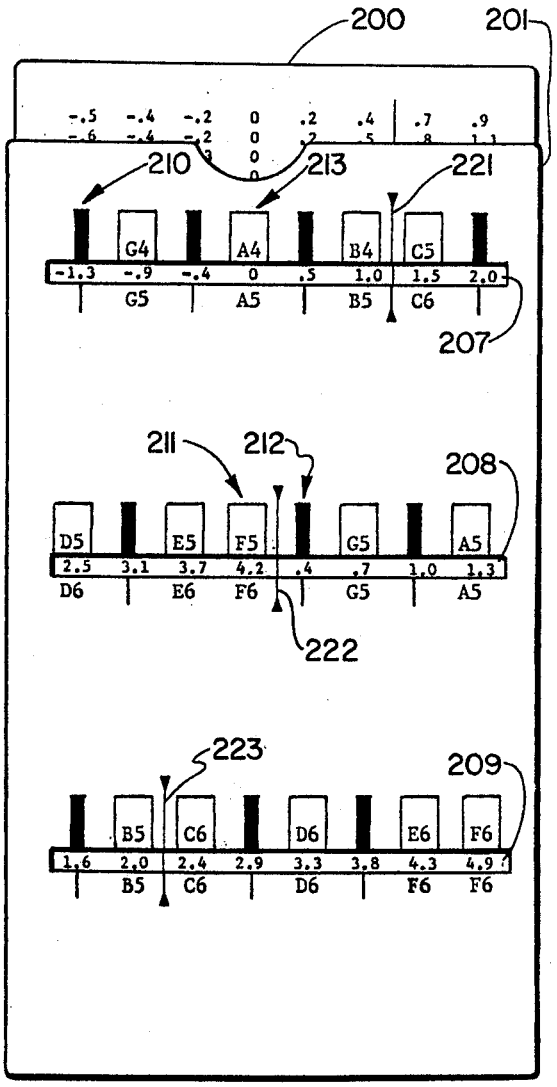

FIG. 5B shows the reverse side of the calculator. It has windows 207, 208 and 209 and covers positions corresponding to notes F # 4 through F6. The deviation numbers from positions 210 for F # 4 to 211 for F5 define a range over which a note is tuned while the second partial is monitored. At position 212, corresponding to the note F # 5, subsequent tuning to note F6 is based on measuring and tuning the first partial frequencies.

In an actual tuning procedure, a piano tuner measures the characteristic stretch number of the piano. The note which is used need not be in exact tune and the measurement only needs to be done once for a piano, as the characteristic stretch number does not change. As the temperament octave spans F3 through F4, a good stretch measurement can be made using F4.

Referring to FIG. 1, the characteristic stretch is measured first by setting selectors 28 and 30 to monitor F5. The tuner them strikes F4 and with the fine control 46 set to a zero position, he adjust the coarse control until the lights from the display 42 stop rotating. The tuning aid thereby is calibrated to the second partial of F4. Now the tuner adjusts the octave selector 30 so the tuning aid monitors the frequencies around F6. While sounding the F4 note, he moves the fine control 46 until the display 42 again stops rotating. The output reading from the control 46, as it is calibrated in cents, directly indicates the characteristic "stretch number " of the piano between the values of the measured second and fourth partials. By using formulas (1) and (2) it can be seen that the characteristic stretch $B_0$ can be obtained. If, for example, the characteristic stretch number of 6 is measured, $B_0 = 0.5$.

Having obtained the stretch number, the tuner adjusts the card 200 shown in FIGS. 5A and 5B, until this number appears in the stretch number window 202. Thereupon the deviation numbers for each note are displayed. Referring to FIG. 5B, it will be noted that position 213 corresponds to A4 on the piano, which is normally 440 Hz. To calibrate the tuning aid so that it corresponds to the numbers from the calculator shown in FIGS. 5A and 5B, the tuner tunes A4 to 440 Hz by resetting the coarse and fine controls 44 and 46 to their zero positions and the selectors 28 and 30 to A4. After the A4 note is tuned the selectors 28 and 30 are set to A5 so the tuning aid monitors the second partial of A4. The coarse control 44 is then adjusted until the display 42 stops rotating. Now the tuning aid and the calculator are calibrated to each other so that subsequent changes in the tuning aid can be read directly from the calculator.

Next, the tuner may start with C3, by setting the selectors 28 and 30 to C5 and rotating the fine control 46 until it is set for 4.9 cents flat. This is the deviation obtained using formula (8) and $K_2=3$. Then each C3 string is tuned individually to stop rotation of the display. When that is accomplished, all the C3 strings are tuned in unison to the tuning frequency, so that their fourth partials are 4.9 cents flat from the nominal frequency.

Next, the tuner can tune C # 3 by changing the note selector 28 to C # and the fine control 46 to a 4.6 cents flat position and then tuning the individual C # 3 strings to their tuning frequency. The tuning continues in this manner until the B3 string, at position 214, has been tuned. The calculator contains a transition mark 215 between the notes B3 and C4. This indicates to the tuner that the octave selector must be changed. Thus, at position 216, the tuning aid selectors 28 and 30 are set to C6 while C4 is being tuned.

Another transition mark 216 is located between the F4 and F # 4 positions 217 and 210, respectively. This is the upper limit of the F3–F4 temperament octave. It is also a point at which the tuner begins to monitor the second partial of the note being tuned. The difference between the deviations at the positions 210 in FIG. 5B and 220 in FIG. 5A corresponds to the overstretch term which is added to the standard calculated deviation equation as in formula (8).

Another transition mark 221 indicates a position at which the octave selector must again be changed so that the tuner can continue to tune notes while monitoring the second partial. Another transition mark 222 signals yet another change where the octave selector 30 is altered and is a position at which the tuner begins to monitor the fundamental of the note while it is being tuned. The transition mark 223 signals another change where the octave selector is changed. The upper notes are tuned using $K_2$=0.75 in formula (8). This would result in a discontinuity if $K_2$ is changed abruptly between these values. However, the differences in tuning frequencies is so slight that the discontinuity can be smoothed by varying $K_2$ over a transition region.

Figure 6A:
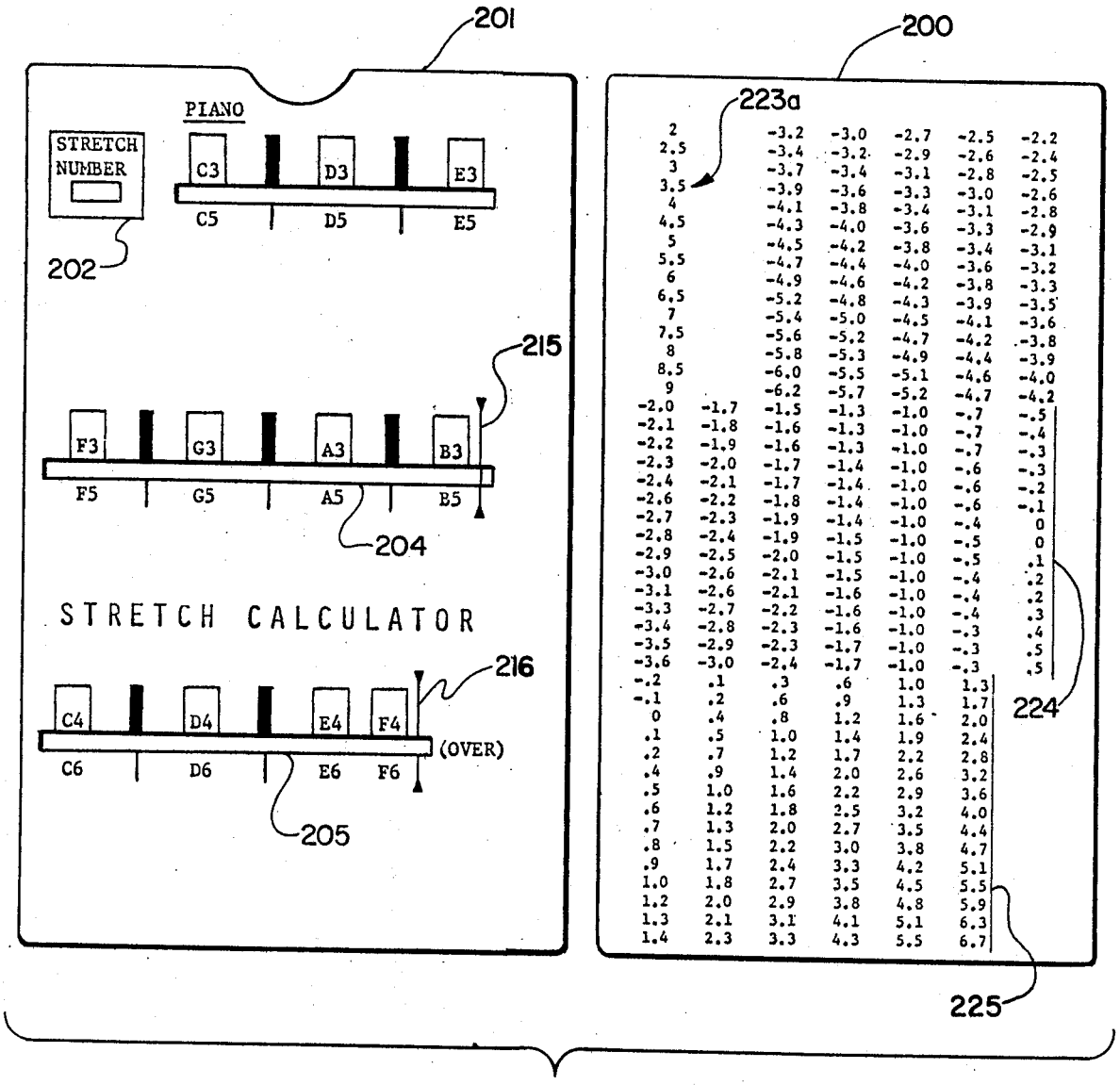
FIGS. 6A and 6B are exploded views corresponding to FIGS. 5A and 5B to show the device in FIG. 5 in more detal.

FIG. 6A shows the card 200 and jacket 201 in juxtaposition. The card 200 defines an array including a plurality of rows and columns. A column 223*a* contains, at the rows therein, stretch numbers which can be viewed through the stretch number window 202. The remaining numbers on the card 200 are all calculated from formula (8) for the note and partial corresponding to each position in the windows. Each column or portion thereof, therefore, corresponds to a particular note to be tuned and partials to be monitored while each row in the matrix corresponds to a characteristic stretch. The column-row instructions provide the deviations for the designated partial.

In order to avoid any ambiguity in using these numbers, the card 200 shown in FIG. 6A contains a line 224 and another line 225 which are in register with the transition marks 215 and 216. So long as the marks 224 and 225 appear in the windows 204 and 205 the card is in a valid position.

Figure 6B:
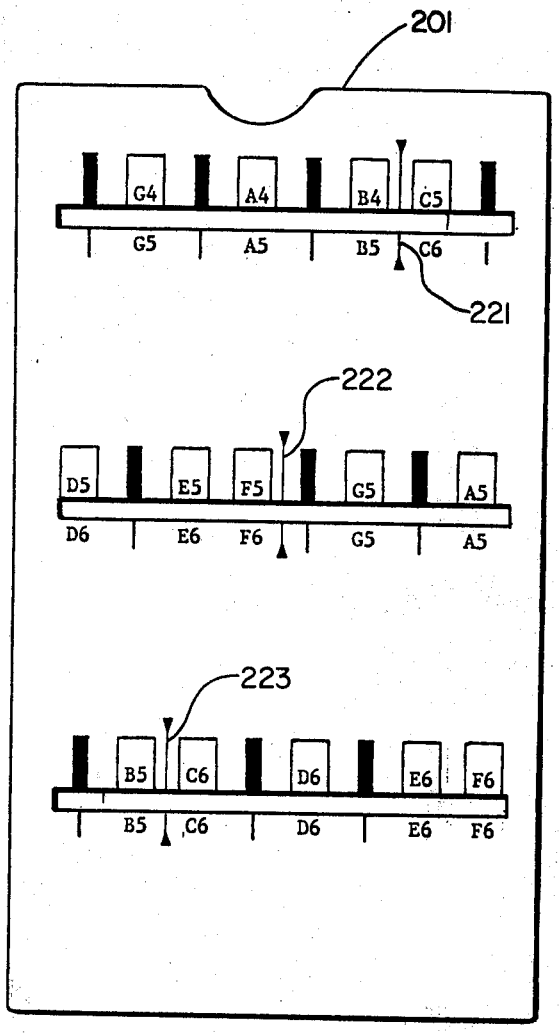

FIG. 6B shows the reverse sides of the card 200 and jacket 201. This side of the card 200 also contains a matrix with portions of columns corresponding to notes and partials of those notes while rows correspond to numbers in the stretch column 223a in FIG. 6A. Likewise, card 200 has on this side printed lines 226, 227, 228 which register with the transition marks 221, 222 and 223.

Once notes C3 through F6 are tuned using the calculator, the remaining notes in the piano may also be tuned. Notes F # 6 through C8 may be tuned by tuning each fundamental to the second partial of the tuned note one octave below. Likewise, bass notes from A0 through B2 are adjusted by tuning the sixth partial to the third partial of the tuned note an octave above.

Figure 6B:
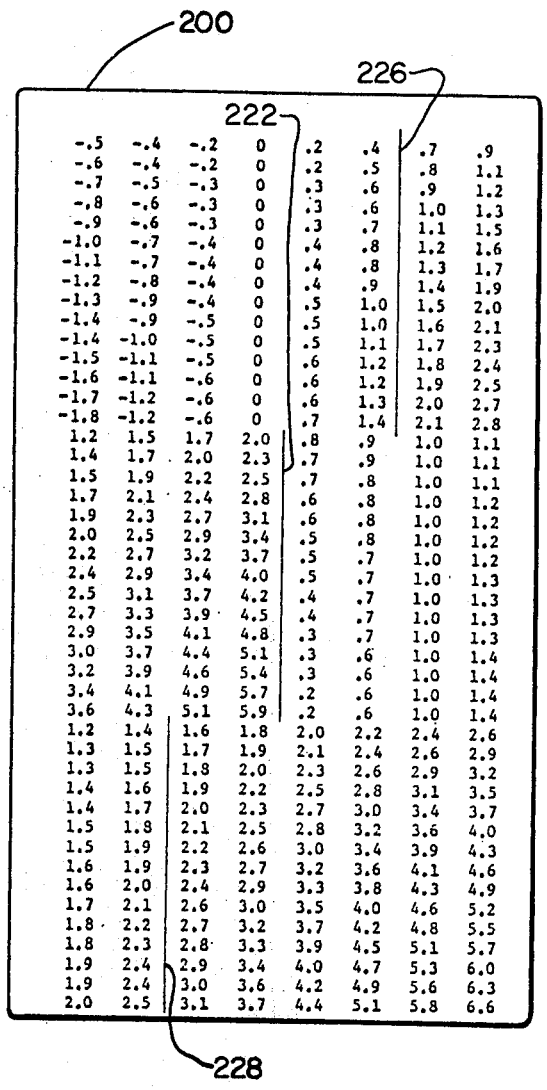

Therefore, in accordance with this invention, I have described a number of variations of a new method for tuning a piano. The variations all have a common characteristic. Unlike the prior art, in each variation a piano tuner measures the characteristic stretch of the piano he is tuning. In addition, a deviation frequency is calculated independently for each note in a temperament octave. In the linear apportionment method, this calculation is easy to make. With the mathematical approach, a more complex calculation is necessary, but it can be greatly simplified merely by constructing a calculator such as shown in FIGS. 5 and 6.

It will also be apparent that other variations can also be used, as there is no reason to limit the deviations to the specifically disclosed values. Other values of the overstretch factor, for example, can be substituted. The data on the calculator may be organized differently. Other modifications and alterations can also be made to my tuning methods and the corresponding calculator without departing from my invention. Therefore, it is an object of the appended claims to cover all such variations and modifications as come within the true spirit and scope of this invention.

What I claim as new and desire to secure by Letters Patent of the U.S. is:

1. A method for tuning a musical instrument comprising a plurality of adjustable frequency tone generators and frequency adjustment means for each tone generator, each tone generator producing a plurality of partials, the partials being of different order with the first order partial for each tone generator corresponding to the lowest frequency produced thereby and with the higher order partials for each tone generator differing in frequency from corresponding order mathematical harmonics of the lowest frequency, said method comprising the steps of:

A. measuring the inharmonicity of the musical instrument by:
   i. energizing one of the tone generators to transmit a tone therefrom,
   ii. measuring, with a tuning device including means for indicating the frequency of the tone from a tone generator, the frequency of a partial of a selected order of the tone, and
   iii. measuring with the tuning device the frequency of another partial of the tone to obtain a characteristic inharmonicity for the musical instrument, B. tuning a reference one of the tone generators to a predetermined standard frequency by:
   i. energizing the reference tone generator to transmit a tone therefrom, and
   ii. adjusting the corresponding frequency adjustment means until the tuning device indicates that the tone is at the predetermined standard frequency, and C. tuning successive ones of the tone generators having different first partials from the reference tone generator, each successive such tuning step including:
   i. energizing the corresponding one of the tone generators to transmit a tone therefrom, and
   ii. adjusting the corresponding frequency adjustment means until the tuning device indicates that the tone is at a corresponding tuning frequency which is the sum of a mathematical frequency for that corresponding tone generator and a deviation frequency that is dependent upon the characteristic inharmonicity of the musical instrument.

2. A method as recited in claim 1 including a tone generator for producing a first partial corresponding to each note in the musical instrument, the first partials covering a plurality of octaves, wherein said successive tone generator tuning steps are used to tune the tone generators in one such octave that is selected as a temperament octave and wherein said method comprises the additional step of:

D. selecting one octave as a temperament octave,

E. tuning each one of the tone generators in the temperament octave to the tuning frequency corresponding thereto as determined in said successive tone generator tuning step, and F. tuning each one of the tone generators outside the temperament octave, each successive such tuning step including:

i. energizing the corresponding tone generator to be tuned to transmit a tone therefrom, and ii. adjusting the frequency adjustment means corresponding to the tone generator being tuned until the tuning device indicates that the tone is at a corresponding octave tuning frequency which corresponds to a partial of a tuned one of the tone generators in octave relationship to the tone generator being tuned.

3. A method as recited in claim 2 wherein the deviation frequency used in said tuning of tone generators in the temperament octave is established by apportioning the measured stretch substantially linearly over the temperament octave.

4. A method as recited in claim 2 including a tone generator for producing a first partial corresponding to each note in the musical instrument, the first partials covering a plurality of octaves, and wherein said successive tone generator tuning step includes calculating the deviation frequency in accordance with $$Y(n,N) = B_0[n^2+K_2][2^{((N-N_0)/K_1)}-1-K_2]$$

wherein Y(n,N) represents the frequency deviation as a percentage of a semi-tone, N is a note number, $B_0$ is an inharmonicity factor of a note $N_0$ based upon the measured inharmonicity of $N_0$, n is a partial, $K_1$ is a calculated slope constant dependent upon the number of notes over which the inharmonicity doubles, and $K_2$ is a calculated octave matching factor dependent upon the selection of partials of the tone generators in octave relationship to be in tune.

5. A method as recited in claim 4 wherein a first set of the successive tone generators is tuned by matching second and fourth partials and using values $K_1 \cong 8.3$ and $K_2 \cong 3$ and a second set of the successive tone generators is tuned matching first and second partials and using the values $K_1 \cong 8.3$ and $K_2 \cong 0.75$.

6. A method as recited in claim 1 including a tone generator for producing a first partial corresponding to each note in the musical instrument, the first partials covering a plurality of octaves, said deviation frequency being determined by calculating a deviation $Y'(n, N)$ in terms of a precentage of a semi-tone in accordance with $$Y'(n,N) = B_0[n^2+K_2][2^{((N-N_0)/K_1)}-1-K_2]+a]1\text{-}2^{((N_0-N)/12)}]$$

wherein N is a note number, $B_0$ is an inharmonicity factor based on the measured inharmonicity of a note $N_0$, n is a partial, $K_1$ is a slope factor representing the number of notes over which the inharmonicity doubles, $K_2$ is an octave matching factor which depends upon the partials for notes in octave relationship which are to be in tune *a* is a constant which represents a desired beat frequency of notes in an octave relation.

7. A method as recited in claim 6 wherein said calculating step is used in determining the tuning frequency for a first set of the successive tone generators in the musical instrument, a second set of the successive tone generators being adjusted by comparing a predetermined partial of a tone generator in the second set with a partial of a corresponding one of the tone generators displaced by an octave.

8. A method as recited in claim 7 wherein an untuned tone generator frequency adjustment means of the second set of tone generators is adjusted by comparing the first partial of its associated tone generator with the second partial of a tuned one of the tone generators an octave below.

9. A method as recited in claim 7 wherein an untuned tone generator frequency adjustment means of the second set of tone generators is adjusted by comparing the sixth partial of its associated tone generator with the third partial of a tuned one of the tone generators displaced an octave above.

10. A method as recited in claim 7 wherein the tuning frequency for each tone generator in a first group of the tone generators in the first set is calculated using the values $K_1 \cong 8.3$, $K_2 \cong 3$ and $a = 1$ and the tuning frequency for each tone generator in a second group of the generators in the first set is tuned by using $K \cong 8.3$, $K_2 \cong 0.75$ and $a = 1$.

* * * * *